US009828199B2

(12) United States Patent
Compagnone

(10) Patent No.: US 9,828,199 B2
(45) Date of Patent: Nov. 28, 2017

(54) TRANSFER DEVICE FOR FLAT SUBSTRATE IN A PACKAGING PRODUCTION MACHINE

(75) Inventor: Giovanni Compagnone, Crissier (CH)

(73) Assignee: BOBST SA (CH)

( * ) Notice: Subject to any disclaimer, the term of this patent is extended or adjusted under 35 U.S.C. 154(b) by 895 days.

(21) Appl. No.: 13/201,656

(22) PCT Filed: Mar. 10, 2010

(86) PCT No.: PCT/EP2010/001454

§ 371 (c)(1),
(2), (4) Date: Aug. 16, 2011

(87) PCT Pub. No.: WO2010/102783

PCT Pub. Date: Sep. 16, 2010

(65) Prior Publication Data

US 2011/0298176 A1 Dec. 8, 2011

(30) Foreign Application Priority Data

Mar. 13, 2009 (EP) ..... 09003643

(51) Int. Cl.

| | |
|---|---|
| ***B65H 5/38*** | (2006.01) |
| *B65B 43/12* | (2006.01) |
| *B65B 59/00* | (2006.01) |

(52) U.S. Cl.

CPC ..... *B65H 5/38* (2013.01); *B65B 43/126* (2013.01); *B65B 59/005* (2013.01);
(Continued)

(58) Field of Classification Search

CPC ..... B65H 5/16; B65H 5/021; B65H 11/00; B65H 2404/691; B65H 2404/693;
(Continued)

(56) References Cited

U.S. PATENT DOCUMENTS 1,041,439 A * 10/1912 Dearborn ..... 198/812
2,179,798 A * 11/1939 Petskeyes ..... 83/84
(Continued)

FOREIGN PATENT DOCUMENTS

DE 10158189 A1 6/2003
JP 55-023375 U 2/1980
(Continued)

OTHER PUBLICATIONS

International Search Report dated Jun. 21, 2010, issued in corresponding international application No. PCT/EP2010/001454.

*Primary Examiner* — Jennifer Swinney
(74) *Attorney, Agent, or Firm* — Ostrolenk Faber LLP

(57) ABSTRACT

A transfer device for one or more flat substrates (4, 4*a*, 4*b*), which can be inserted between two successive units upstream and downstream (3, 6, 9) in a packaging production machine (1), the device including a bridge (14) with an upper surface (16) providing a junction between the upstream unit (3, 6) and the downstream unit (9). An adjustment device (19) varies a length (L1, L2) of the bridge (14). The bridge (14) is a static apron on which the substrate (4, 4*a*, 4*b*) slides, having a fixed transversal end (36) and a mobile transversal end (22). The adjustment device (19) varies a position of the mobile end (22), as a function of a spacing (E1, E2) between the two units.

8 Claims, 2 Drawing Sheets

(52) U.S. Cl.
CPC .... *B65H 2404/691* (2013.01); *B65H 2511/11* (2013.01); *B65H 2511/22* (2013.01); *B65H 2701/1764* (2013.01)

(58) Field of Classification Search
CPC ..... B65H 2701/125; B65H 5/38; B65H 2404/6911; B65H 29/52; B65H 2511/11; B65H 2511/12; B65D 29/52; B65G 47/52; B65G 47/66; B65G 47/44; B65G 35/04; B65G 33/22
USPC ..... 83/437.4, 111, 310; 198/812, 313, 594, 198/861.1, 690.2, 539; 271/264; 193/31 R, 35 TE
See application file for complete search history.

(56) References Cited

U.S. PATENT DOCUMENTS 2,286,055 A * 6/1942 Brittell ..... 198/690.2
2,576,217 A * 11/1951 Eggleston ..... 198/313
2,631,715 A * 3/1953 Vickers ..... 198/812
3,216,552 A * 11/1965 Lister, Jr. ..... 198/313
3,237,743 A * 3/1966 Seaborn ..... 193/31 R
3,433,343 A * 3/1969 Giulie ..... 193/31 R
3,947,902 A * 4/1976 Conde et al. ..... 5/81.1 C
4,475,527 A * 10/1984 Kuo ..... 125/13.01
5,637,183 A 6/1997 Beorner
5,761,883 A * 6/1998 Pruett et al. ..... 53/448
7,017,640 B2 * 3/2006 Winter et al. ..... 156/562
7,533,768 B2 * 5/2009 Floding et al. ..... 198/419.3
8,448,777 B2 * 5/2013 Pazdernik ..... 198/460.2
2004/0094391 A1 5/2004 Schaum et al.
2007/0108021 A1 5/2007 Thompson

FOREIGN PATENT DOCUMENTS

JP 63122126 A * 5/1988 ..... H01L 21/304
WO WO 2005/012145 A 2/2005

* cited by examiner

TRANSFER DEVICE FOR FLAT SUBSTRATE IN A PACKAGING PRODUCTION MACHINE

CROSS-REFERENCE TO RELATED APPLICATIONS

The present application is a 35 U.S.C. §§371 national phase conversion of PCT/EP2010/001454, filed Mar. 9, 2010 which claims priority of European Application No. 09003643.5, filed Mar. 13, 2009, the contents of which are incorporated by reference herein. The PCT International Application was published in the French language.

The present invention relates to a device for transferring one or more flat substrates. via the device, which is mounted between two successive units in a packaging production machine.

A packaging production machine is intended for producing boxes, which form packaging, after folding and gluing of the boxes. An initial flat substrate used in the machine is, for example, a continuous substrate, such as a virgin web of cardboard. The web is unwound continuously, and is printed by a print unit, which in turn is comprised of subunits in the form of printing units. The web is transferred into a cutting unit, which is a diecutting platen press.

After the web is cut, the resulting blanks have areas of waste which are separated and eliminated in a waste stripping unit mounted after the press. The boxes are then separated, shingled, before being stacked in rows to form stacks in a delivery and palletizing station, for being stored or conveyed out of the machine.

Inside the machine, each unit is separated from the neighboring unit by a longitudinal spacing along the path of the web and blanks. This spacing is a function of the individual length of each of the units making up the machine and a function of the space available in the factory for the machine. The spacing is also useful if a unit is replaced by another. Even if the new unit comes from a different designer and has a different length, it should be able to be easily inserted into the machine, without all of the other units having to be dismantled.

The spacing between units is also useful to allow an operator to cross the machine from the operator's side to the opposite side. The spacing gives the operator access, for example, to the drive members or to certain electrical functions situated at the rear of the machine. The spacing enables the operator to also reach the upstream or downstream transversal side of the unit, for example for cleaning purposes, or to clear jammed cardboard. The operator or the installer of the machine can work on parts situated at the heart of the upstream unit and of the downstream unit without being obstructed, whereby the spacing improves maintenance ergonomics.

To enable the web, or the blanks and the boxes, to pass from one upstream unit to another downstream unit, various active or passive transfer means are provided. These means bridge the spacing between the upstream unit and the downstream unit.

State of the Art

In a print machine in which the web passes through a succession of units, driven or undriven cylinders arranged parallel to one another drive the web and/or keep it tensioned.

In a machine of a folder-gluer or diecutting platen press type, there is an active friction-based drive system, for example with a conveyor with lower and upper endless belts, or with a conveyor with lower endless belts and upper pressure rollers, or with a conveyor with a lower endless belt associated with a vacuum, or with a series of parallel rollers or a ball frame, with or without vacuum. This drive system allows circulating the blanks and the boxes before or after cutting and separation.

Also known from U.S. Pat. No. 4,768,912 is a paper jogging apparatus with sheets of paper passed from a paper feed table to a paper stacking table. The apparatus also comprises a paper passage plate and a vibration transfer plate. The passage plate covers the vibration transfer plate, and the latter is arranged in proximity to the top area of the stacking table.

The passage plate has an incurved shape to cause free transit of the cardboard sheets to the vibration transfer plate. The passage plate thus bridges a portion of the spacing between the feed and stacking tables to facilitate the cardboard transfer function.

However, such drives, or passage plates or transfer devices have a drawback of being designed from the outset with the correct length in order to be able to be inserted into the machine. If the packaging manufacturer wants to replace just one unit inside his machine, they may also have to change one or more substrate transfer devices, situated upstream and/or downstream of the new unit.

Furthermore, the flat substrates have to be able to be transferred from an upstream unit to a downstream unit, without having to modify their position and their speed. The position of the flat substrate or substrates must remain identical relative to the median longitudinal axis of the upstream unit and of the machine, between the output of the upstream unit and the input of the downstream unit. The speed, or, where appropriate, the acceleration, of the flat substrate or substrates must remain constant between the output of the upstream unit and the input of the downstream unit.

SUMMARY OF THE INVENTION

One main objective of the present invention is to provide a device that allows providing a circulation, or a continuous transfer of one or more flat substrates in a packaging production machine. A second objective is to produce a device for transferring a flat substrate, which device can be adapted to all types of machines in which it is inserted. A third objective is to facilitate the displacement of a flat substrate by a transfer device. A fourth objective is to transfer a flat substrate from one unit to another unit regardless of the dimensions of the substrate. Yet another objective is to provide a packaging production machine with one or more substrate transfer devices incorporated between an upstream unit and a downstream unit.

A transfer device for one or more flat substrates can be inserted between two successive units, an upstream unit and a downstream unit, in a packaging production machine. The transfer device comprises a bridge with an upper surface providing a junction between the upstream unit and the downstream unit and adjustment means for varying a length of the bridge.

According to one aspect of the present invention, the transfer device bridge is a static apron, on which the flat substrate or substrates slide. The apron has a fixed transversal end and a mobile transversal end. The adjustment means vary a position of the mobile transversal end, according to a spacing that exists between the two successive units, the upstream unit and the downstream unit.

Throughout the description, the flat substrate is defined, by way of nonlimiting example, as being in the form:

of a web, for example of paper, or of cardboard, or of plastic, such as polyethylene terephthalate (PET), of biori-ented polypropylene (BOPP), or of other polymers, or of aluminum, or of other materials, or in the form of a plate or sheet substrate, for example flat cardboard, or corrugated cardboard, or even a flexible material, such as polyethylene (PE), or yet other materials, or in the form of a substrate in the form of boxes or blanks, resulting from a cutting in a diecutting platen press or in a rotary diecutter.

The upstream and downstream directions are defined with reference to the direction of displacement of the substrate, according to the longitudinal direction in the infeed station and throughout the converting machine. The longitudinal direction is defined with reference to the direction of displacement of the substrate in the machine, according to its median longitudinal axis. The transversal direction is defined as being the direction perpendicular to the direction in which the substrate is driven.

The units are defined, by way of nonlimiting examples, as being printing units, embossing units, a rotary diecutting unit, a diecutting platen press, an infeed station for diecutting platen press, a waste stripping unit, a blank separator, a delivery, or others.

In other words, the device allows filling any spacing or any separation that might exist between two units inside a machine. Compared to the drives or passage plates of the prior art which all have a fixed length, the device according to the invention can be used to create a variable length bridge at will.

The device has no drive. The surface of the bridge is designed so that the substrate slides without encountering obstacles. The substrate is displaced by virtue of its own inertia, its speed or its acceleration being generated by the upstream unit.

An additional advantage is that the transfer device also comprises adjustment means for varying a length of the junction bridge, as a function of the length of the substrate. By virtue of this adjustable length of the device, the substrates are still held and driven at their rear edge by the upstream unit, when the same substrates are caught then driven at their front edge by the downstream unit.

According to another aspect of the invention, a packaging production machine, incorporating an upstream unit in the form of a unit for converting a substrate, comprises a device having one or more of the technical features described hereinbelow installed downstream of the upstream substrate converting unit.

Through its ease of adaptation, such a device is inserted between two units. This allows for all length modifications for the upstream or downstream unit.

BRIEF DESCRIPTION OF THE DRAWINGS

The invention will be better understood and its various advantages and different features will better emerge from the following description, of the nonlimiting embodiment, with reference to the appended schematic drawings, in which.

DETAILED DESCRIPTION OF PREFERRED EMBODIMENTS

Figure 1:
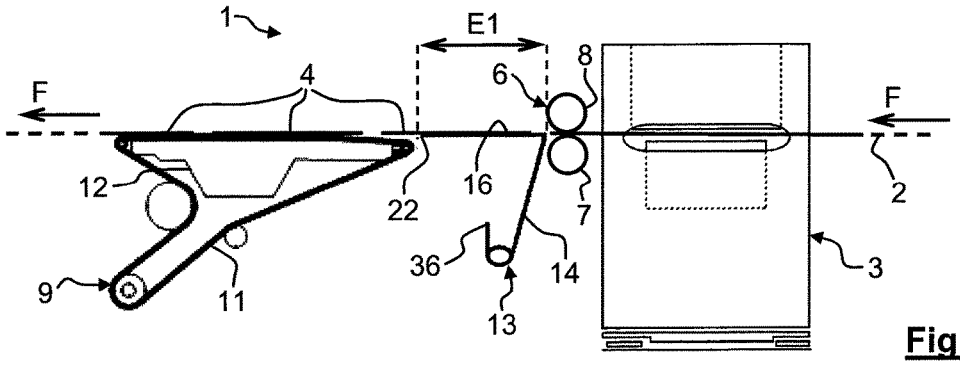
FIG. 1 represents a synoptic side view of a packaging production machine equipped with a substrate transfer device in a spread position according to the invention.
Figure 3:
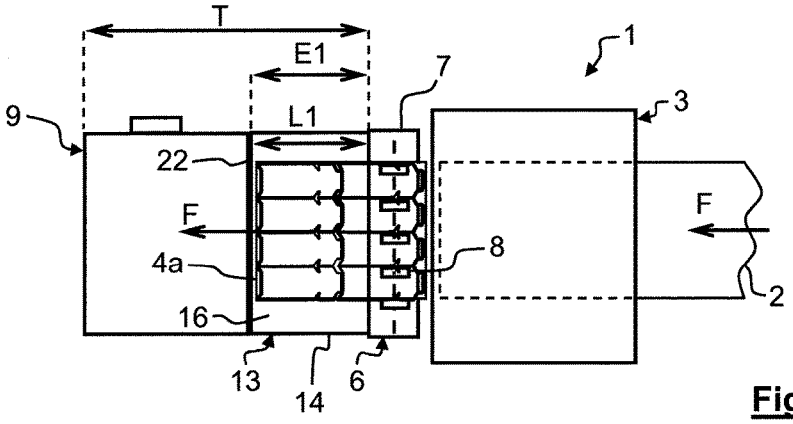
FIG. 3 represents a synoptic upper view of the packaging production machine, with the device of FIGS. 1 and 2 in a spread position.
Figure 4:
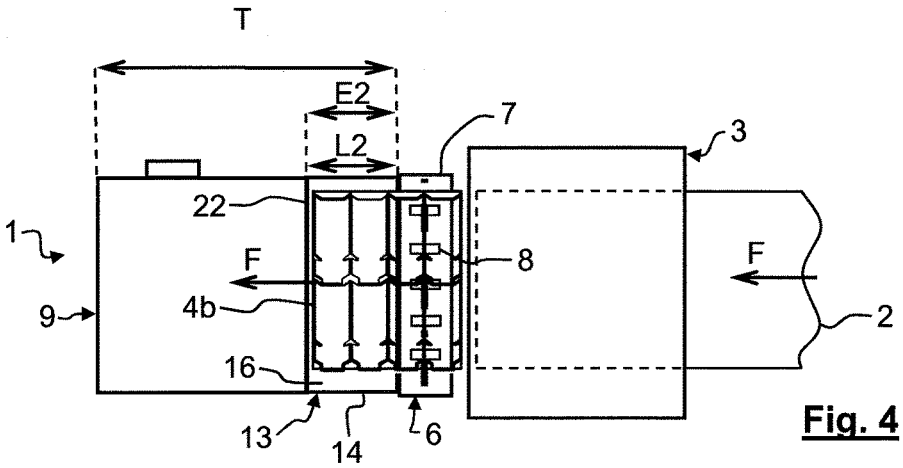
FIG. 4 represents a synoptic upper view of the packaging production machine with the device of FIGS. 1 and 2 in a retracted position.

As FIGS. 1, 3 and 4 illustrate, a packaging production machine (1) converts a substrate or a web material (2), here being flat cardboard. The machine (1) comprises a converting unit, which is, in this case, a diecutting platen press (3).

The web (2) enters into the press (3) through its upstream transversal side. The web (2) arrives in the press (3) with an intermittent speed, which is rated by virtue of an infeed station (not represented). Upstream of the press (3) and therefore of the infeed station, the machine (1) may also have, by way of example, units such as printing units, means for checking quality and register, embossing units, and so on (not represented).

The press (3) cuts the web (2) and delivers the substrate in the form of blanks (4), here therefore being of flat cardboard. The blanks (4) leave the press (3) through its downstream transversal side. The direction of advance or of progress (arrows F in the figures) of the web (2) and of the blanks (4) in the longitudinal direction indicates the upstream direction or the downstream direction.

The machine (1) comprises a unit, in the form of a driving arrangement (6), which is placed downstream of the press (3). This arrangement (6) comprises, a lower drive roller (7), driven in rotation by a motor and comprises just one or a series of pressure rollers (8), arranged above, bearing on the roller (7).

The blanks (4) are engaged, held and driven between the roller (7) and the roller or rollers (8). The arrangement (6) ensures an active transfer of the blanks (4). The arrangement (6) is intended to draw the blanks (4), in succession one after the other, from the press (3), in the longitudinal direction (F), from upstream to downstream.

The machine (1) comprises a transport unit, known under the name of vacuum transport (9), which is placed downstream of the press (3), after the driving arrangement (6). This vacuum transport (9) comprises a conveyor with one or more lower endless belts (11) with orifices. A vacuum box (12), connected to a vacuum source, draws the blanks (4) against the belt or belts (11).

The blanks (4) are placed, one after the other, with a short gap between them on the upper face of the belts (11). The vacuum transport (9) ensures an active transfer of the blanks (4). The belt or belts (11) drive the blanks (4), in the longitudinal direction (F), from upstream to downstream.

The spacing (E1 and E2) between the two units, the driving arrangement (6) and the vacuum transport (9) are variable from one machine to another. These spacings (E1 and E2) are a function of the respective positioning and the length of these two units (6 and 9), incorporated in the packaging production machine (1).

The machine (1) comprises a waste stripping unit (not represented), which is placed downstream after the vacuum transport (9). In a controlled manner, this unit eliminates the cardboard wastes precut from the blanks (4).

The packaging production machine (1) comprises a transfer device according to the invention (13) for one or more flat substrates, i.e. the blanks (4). The device (13) can be inserted between two successive units, an upstream unit and a downstream unit. The device (13) is intended to convey the blanks (4) from an upstream unit in the form of the diecutting platen press (3) to a downstream unit in the form of the waste stripping unit.

More precisely, in a particularly interesting embodiment, the machine (1) may comprise, in order, from upstream to downstream, the diecutting platen press (3), the driving arrangement (6), the device (13), the vacuum transport (9), and the waste stripping unit. In other words, the device (13) is placed downstream at the output of the driving arrangement (6) and upstream at the input of the vacuum transport (9).

The device (13) provides a passive transfer of the blanks (4). For this, and as can be seen in the figures, the device (13) comprises a bridge (14) providing a junction between the upstream unit, i.e. the driving arrangement (6), and the downstream unit, i.e. the vacuum transport (9). The junction bridge (14) is in the form of an inverted L. The bridge (14) is similar to an apron, with an upper surface (16) and a lower flank (17).

The blanks (4) pass slidingly on the upper surface (16). The upper surface (16) of the bridge (14) may be preferentially substantially flat. In this embodiment, the upper surface (16) is substantially horizontal. The upper surface (16) guarantees a continuous plane between a surface located inside the press (3), the driving arrangement (6) and the vacuum transport (9). The blanks (4) thus circulate in this plane following the longitudinal direction (F).

For the blanks (4) to be displaced by their own inertia, the upper surface (16) may be advantageously substantially smooth. The upper surface (16) is antistatic. The upper surface (16) is non-adherent and may have a low friction coefficient. In this way, the blanks (4) will slide without the risk of their front flaps catching.

The lower flank (17) of the bridge (14) is placed below the arrangement (6) and is substantially vertical or substantially parallel to the downstream transversal side of the press (3). The transition between the upper surface (16) and the lower flank (17) is provided by a transversal bar (18) forming an edge. The lower flank (17) of the bridge (14) thus serves as storage for the unused length of the bridge (14), for adjusting the length (L1 and L2).

The bridge (14) may favorably be made of a material that may be capable of being deformed. By way of example, the surface (16) of the bridge (14) may be made of thermoplastic polyurethane with a thickness substantially equal to 1 mm. This softness or flexibility allows for the passage of the bar (18). Such a material makes the bridge (14) able to be easily spread, then retracted, according to the desired length (L1 and L2).

As FIGS. 3 to 6 show, a length (L1 and L2) of the device (13), and more precisely of the upper surface (16) of the bridge (14), varies according to the spacing (E1 and E2) that exists between the two successive units, the upstream unit, i.e., for example, the arrangement (6), and the downstream unit, i.e., for example, the vacuum transport (9). All the lengths between L1 and L2 can be chosen and then set by the operator.

The machine (1) may also favorably incorporate a downstream unit i.e., for example, the vacuum transport (9) with variable length. In this case, the length (L1 or L2) of the device (13) added to the length of the downstream unit (9) may be constant (T). The vacuum transport (9) can thus have a variable length. It is possible to choose the length (L1, L2) of the device (13) such that the latter when added to the length of the vacuum transport (9) remains a constant (T).

The length (L1 or L2) of the bridge (14) can be chosen as a function of the size of the blanks (4*a* and 4*b*). In this way, the blank (4*a* and 4*b*) always retains a front and/or rear region driven by the arrangement (6) and/or by the vacuum transport (9).

In the case that can be seen in FIG. 3, the blanks (4*a*) have a greater length ("long grain" cardboard). The operator will extend the length (L1) of the bridge (14) and will shorten the length of the vacuum transport (9), keeping the overall length (T) constant. In the case that can be seen in FIG. 4, the blanks (4*b*) have a shorter length ("short grain" cardboard). The operator will shorten the length (L2) of the bridge (14) and will extend the length of the vacuum transport (9), keeping the overall length (T) constant.

The transfer device (13) thus comprises adjustment means (19) for varying this length (L1 and L2) of the bridge (14). Using these adjustment means (19), the operator adjusts the length (L1 and L2) of the bridge (14), so that the latter corresponds to the spacing (E1 and E2). For a good circulation and holding of the blanks (4, 4*a* and 4*b*), a spacing value (E1 or E2 or intermediate) is equal to a length (L1 or L2 or intermediate) of the bridge (14).

Preferably, the adjustment means (19) may comprise at least one slider joined to the bridge (14). In the present case, two sliders may be in the form of two lateral nuts (21*a* and 21*b*), positioned on either side of the bridge (14). The two nuts (21*a* and 21*b*) may advantageously each be secured to a transversal, upper, downstream and mobile end (22) of the bridge (14), laterally, i.e. on the operator's side and the side opposite the operator's side.

Favorably, the adjustment means (19) may comprise at least one slide fixed to a frame (not represented) of the device (13). In the present case, two lateral slides may be in the form of two ball screws (23*a* and 23*b*), positioned on either side of the bridge (14). The two screws (23*a* and 23*b*) may preferably each be secured laterally, i.e., operator's side and opposite the operator's side, to the frame (not represented) of the device (13), while remaining able to rotate. The two screws (23*a* and 23*b*) are arranged parallel to one another, in the same plane as that formed by the upper surface (16), substantially horizontally.

The two screws (23*a* and 23*b*) may be rotatably driven by a single motor (24), arranged on the operator's side. Two gears (26*a* and 26*b*), placed on the operator's side and on the opposite operator' side, and a return shaft (27) allow the movement to be transmitted from the operator's side to the side opposite the operator's side.

The slider, i.e. the two nuts (21*a* and 21*b*), may cooperate with the slide, i.e. the two screws (23*a* and 23*b*). When the two screws (23*a* and 23*b*) are rotated by the motor (24), they drive the two nuts (21*a* and 21*b*) in longitudinal displacement (arrows D and I in FIGS. 2, 5 and 6).

When the two screws (23*a* and 23*b*) rotate in a first direction, the two screws (21*a* and 21*b*) are displaced upstream (D), driving the end (22) of the bridge (14) in the upstream direction. The length of the bridge (14) reduces and changes from a value L1 to L2. When the two screws (23*a* and 23*b*) rotate in a second direction opposite to the first direction, the two nuts (21*a* and 21*b*) are displaced downstream (I), driving the end (22) of the bridge (14) in the downstream direction. The length of the bridge (14) increases and changes from a value L2 to L1.

The longitudinal displacement (D and I) of the two nuts (21*a* and 21*b*) is stabilized by two rules (28), securely attached to the frame of the device (13). Each of the two rules (28) corresponds and is respectively parallel to each of the two screws (23*a* and 23*b*). Each of the two nuts (21*a* and 21*b*) comprises a lower part (29) sliding on the rule (28).

To compensate for the length variations (L1 and L2) of the bridge (14) and to be able to keep the bridge (14) at a constant tension, the device (13) may preferably comprise tension means (31). Advantageously, the tension means (31) may comprise two lateral jacks (32*a* and 32*b*). These two jacks (32*a* and 32*b*) may be positioned laterally on either side of the bridge (14), and secured to a frame of the device (13). The two jacks (32*a* and 32*b*) are provided, mounted vertically, at the lower flank (17), on the operator's side and on the side opposite the operator's side. Each of the two jacks (32*a* and 32*b*) comprises a mobile piston (33*a* and 33*b*) oriented downwards.

The end portion of each of the pistons (33*a* and 33*b*) ends with a bearing (34*a* and 34*b*). Each of the two bearings (34*a* and 34*b*) holds a transversal rod (35). The rod (35) ensures the transition between the lower flank (17) of the bridge (14) and a transversal, lower, upstream and fixed end (36) forming a transversal fastening for securing the bridge (14) to the frame. The fixed transversal end (36) is located upstream and below the mobile transversal end (22). The lower flank (17) and the fixed end (36) are retracted under the upper surface (16) of the bridge (14).

By forming an edge, the rod (35) constitutes a return point or edge for the bridge (14). Each of the two bearings (34*a* and 34*b*) slides vertically (arrows B and H in FIGS. 2, 5 and 6) in a guide (37*a* and 37*b*).

Figure 2:
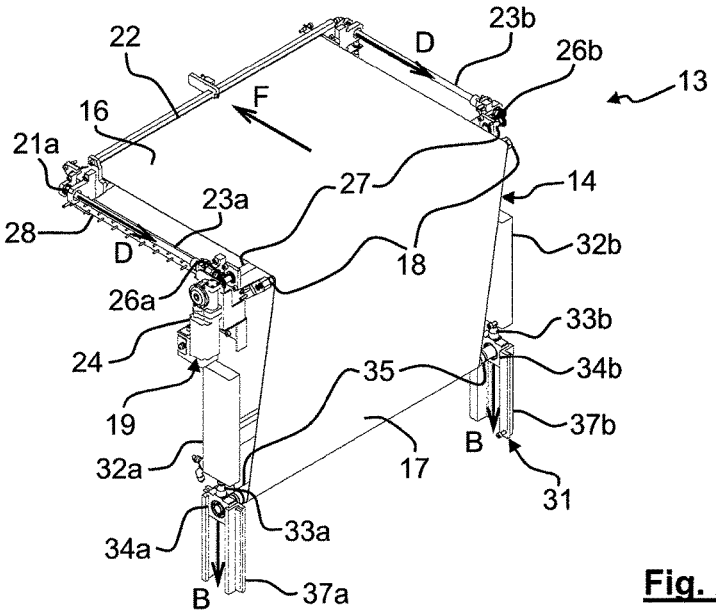
FIG. 2 represents a perspective view of the device.
Figure 5:
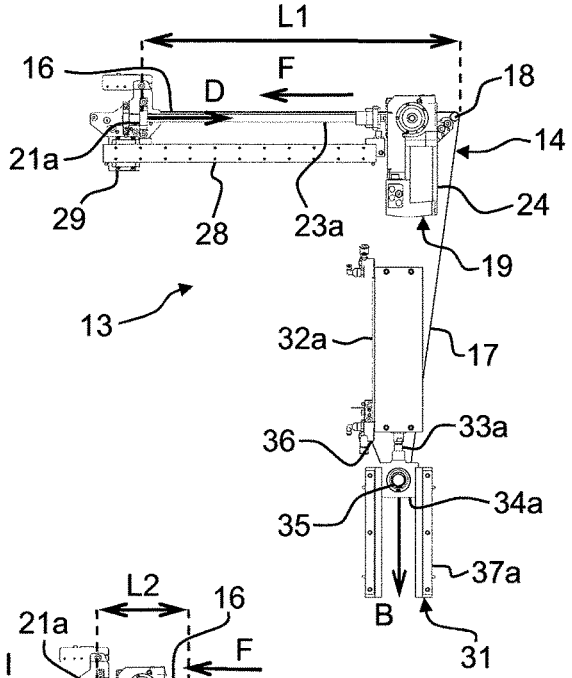
FIG. 5 represents a side view of the device in a spread position.
Figure 6:
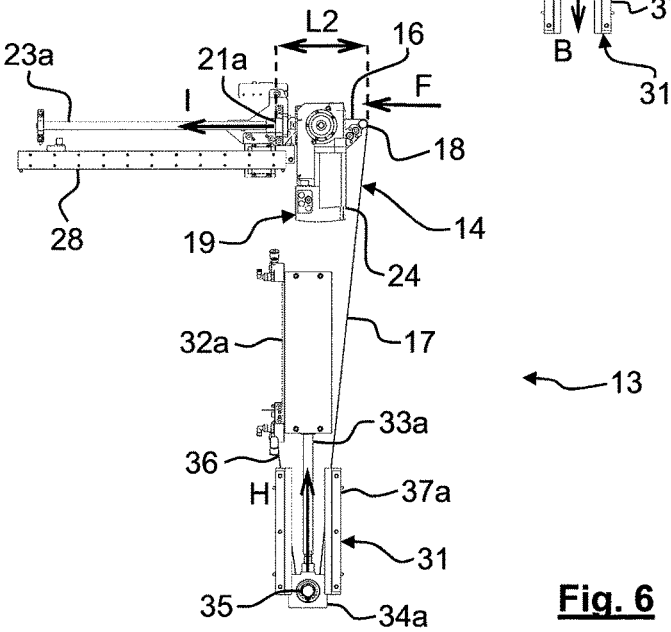
FIG. 6 represents a side view of the device in a retracted position.

As FIGS. 2 and 5 show, when the two bearings (34*a* and 34*b*) and the two pistons (33*a* and 33*b*) of the two jacks (32*a* and 32*b*) move down by sliding vertically (B) in the two respective guides (37*a* and 37*b*), the rod (35) moves down. The two ball screws (23*a* and 23*b*) simultaneously return the two nuts (21*a* and 21*b*) in the upstream direction, and the rod (35) is thrust downward under the action of the two jacks (32*a* and 32*b*). The length of the upper surface (16) of the bridge (14) decreases (from L1 to L2).

Conversely, (see FIG. 6), when the two bearings (34*a* and 34*b*) and the two pistons (33*a* and 33*b*) of the two jacks (32*a* and 32*b*) move up by sliding vertically (H) in the two respective guides (37*a* and 37*b*), the rod (35) rises. The two ball screws (23*a* and 23*b*) simultaneously return the two nuts (21*a* and 21*b*) in the downstream direction, and the rod (35) is returned upward. The length of the upper surface (16) of the bridge (14) increases (from L2 to L1).

Under the action of the two jacks (32*a* and 32*b*), the tension of the bridge (14) is kept constant, regardless of the lengths (L1, L2 or intermediate) of the bridge (14).

The present invention is not limited to the embodiments described and illustrated. Many changes can be made, without in any way departing from the framework defined by the scope of the set of claims.

The invention claimed is:

1. A transfer device for one or more substrates, the transfer device having a frame and being insertable between two successive units, including an upstream unit and a downstream unit, in a packaging production machine, the upstream unit and the downstream unit being separated from each other by a spacing, the transfer device comprising:

a bridge providing a junction between the upstream unit and the downstream unit, the bridge comprising:

an adjustment device for varying a length of the bridge;

an apron comprising an upper surface on which the one or more substrates slide and a lower flank, the apron being motionless when the packaging production machine is in active operation, the apron comprising a fixed transversal end toward one unit and a mobile transversal end toward the other unit, wherein a position of the mobile transversal end of the apron is configured to be moved in a first direction as a function of the spacing between the two successive units, and wherein the adjustment device comprises at least one slide secured to the frame and at least one slider cooperating with the at least one slide, the at least one slider is secured to lateral sides of the mobile transversal end, and the at least one slide is driven by a motor to longitudinally displace the at least one slider and the mobile transversal end of the apron to vary the length of the bridge; and at least one tensioner comprising a moving member and a transverse bar, the at least one tensioner adjusting a position of the lower flank by moving the moving member and the transverse bar along a linear path in a second direction in relation to the longitudinal displacement of the at least one slider, the second direction being transverse to the first direction.

2. A device according to claim 1, wherein the at least one slider is in the form of lateral nuts, and the adjustment device further comprises:

two lateral slides, each in the form of a ball screw, and each rotatably driven by the motor, positioned on either side of the bridge, and secured to the frame.

3. A device according to claim 1, wherein the upper surface of the bridge is flat, smooth and horizontal.

4. A device according to claim 1, wherein the bridge is made of a deformable material.

5. A device according to claim 1, wherein the at least one tensioner keeps the bridge at a constant tension.

6. A device according to claim 5, wherein the moveable member comprises two lateral jacks, each jack positioned in an opposing arrangement on either side of the bridge and fixed to the frame.

7. A device according to claim 1, wherein the fixed transversal end is upstream of and beneath the mobile transversal end.

8. The device according to claim 1, further comprising:

a guide having a longitudinal component positioned along the second direction, wherein the movement of the moving member is along the guide in response to the varying of the length of the bridge.

* * * * *